United States Patent [19]

Kinnan

[11] Patent Number: 4,866,214

[45] Date of Patent: Sep. 12, 1989

[54] SERVICE CABLE FOR A SUBSOIL PENETRATING TOOL AND METHOD OF PREVENTING ROTATION OF THE CABLE WHEN IN USE

[75] Inventor: Frank R. Kinnan, Camas Valley, Oreg.

[73] Assignee: Underground Technologies, Inc., Byron, Calif.

[21] Appl. No.: 201,468

[22] Filed: Jun. 2, 1988

Related U.S. Application Data

[62] Division of Ser. No. 115,987, Nov. 2, 1987.

[51] Int. Cl.[4] ..... H01B 7/18; F16L 11/12

[52] U.S. Cl. ..... 174/47; 174/70 R

[58] Field of Search ..... 174/40 TD, 41, 45 TD, 174/47, 70 R, 70 A, 79, 107, 108, 115, 131 R, 131 A

[56] References Cited

U.S. PATENT DOCUMENTS

| | | | |
|---|---|---|---|
| 2,604,509 | 7/1952 | Blanchard | 174/108 |
| 3,060,260 | 10/1962 | Scofield | 174/41 X |
| 3,573,349 | 4/1971 | Bowers | 174/108 |
| 4,250,351 | 2/1981 | Bridges | 174/115 X |
| 4,278,835 | 7/1981 | Jackson | 174/70 R |

FOREIGN PATENT DOCUMENTS

| | | | |
|---|---|---|---|
| 0186448 | 7/1986 | European Pat. Off. | 174/70 R |
| 1594702 | 8/1981 | United Kingdom | 174/47 |

*Primary Examiner*—Larmie E. Askin

*Attorney, Agent, or Firm*—David Teschner

[57] ABSTRACT

A cable used with a subsoil penetrating tool which contains a plurality of tubes and hoses used to transport all operational fluids and a plurality of electrical conducting wires used to transmit power ane electrical impulses for information. A unique internal structure reduces the rotation of the cable as the tool advances and provides rigidity to the cable to allow for the transmission of compressional forces along the cable to be applied to the advancing tool.

11 Claims, 15 Drawing Sheets

SERVICE CABLE FOR A SUBSOIL PENETRATING TOOL AND METHOD OF PREVENTING ROTATION OF THE CABLE WHEN IN USE

This application is a division of application Ser. No. 115,987 filed Nov. 2, 1987.

BACKGROUND OF THE INVENTION

1. Field of the Invention

The invention is directed to service cables used with subsoil penetrating tools in subsurface trenching for the installation and removal of various utility items such as electrical cable, conduit, water pipes, sewer pipes and the like.

2. Description of the Prior Art

The usual cable used with subsoil penetrating tools typically only provides the power used to drive the nose boring mechanism as with electrical, hydraulic, air or water connections. The cable is then drawn ahead by the forward action of the boring tool. When any driving force was provided by a member following the tool, that member had to be rigid. An example of such a rigid member would be rigid pipe used to drill vertical holes for oil.

None of these prior art devices included a cable which could be wound on a reel, able to provide utilities to the boring mechanism and also to assist the tool in its boring operation by providing an axial force to the tool in its advancing direction.

SUMMARY OF THE INVENTION

The instant invention overcomes the difficulties noted above with respect to prior art devices. The cable which is behind the tool provides a plurality of tubes and hoses for transporting all operational fluids and a plurality of electrical conducting wires to transmit power and electrical impulses for information. A unique internal structure reduces the rotation of the cable as the tool advances and provides rigidity to the cable to allow for the transmission of compressional forces along the cable to be applied to the advancing tool. The unique internal structure includes two rings of fiberglass rods arranged in generally opposite directions and a cooperating-central steel wire.

Without the unique interior structure of the service cable, any compressive force placed on the cable would initially result in the cable bulging until the bulge filled the hole the tool was drilling. Because the bulging created frictional contact between the cable and the drilled hole, frictional forces also had to be overcome before the compressional force could be translated along the cable to the boring tool.

With the unique internal structure, excessive bulging does not occur which reduces the frictional contact between the service cable and the drilled hole. The cable continues to bulge under compression until the oppositely wound rods go into tension. They go into tension due to the outward bulging forces from the cable. After the rods go into tension, the service cable becomes rigid. Once rigid, additional axial compressive forces will be easily translated down the service cable to assist the advancing boring tool.

The feed reel for the cable carries a separate device to pretension the control steel wire. The reel is mounted upon a carriage to measure the tension applied to the cable as it is withdrawn from the base.

It is an object of the invention to provide a flexible service cable containing all fluid and hydraulic lines and electrical conductors needed for the operation of a subsoil penetrating tool which substantially prevents the rotation of the cable and tool as the tool advances.

It is another object of the invention to provide a flexible service cable for a subsoil penetrating tool using two belts of fiberglass rods arranged in generally opposite directions and a pretensioned central steel wire which substantially prevents the rotation of the cable and of the tool as the tool advances.

It is yet another object of this invention to provide a flexible service cable for a subsoil penetrating tool which can provide all of the objects listed above and be able to be wound around a reeling device which controls the amount of pretention in such cable during both reeling and unreeling of the service cable.

Other objects and features of the invention will be pointed out in the following description and claims and illustrated in the accompanying drawings, which disclose, by way of example, the principles of the invention and the best mode which has been contemplated for carrying them out.

DESCRIPTION OF THE PREFERRED EMBODIMENT

Figure 1:
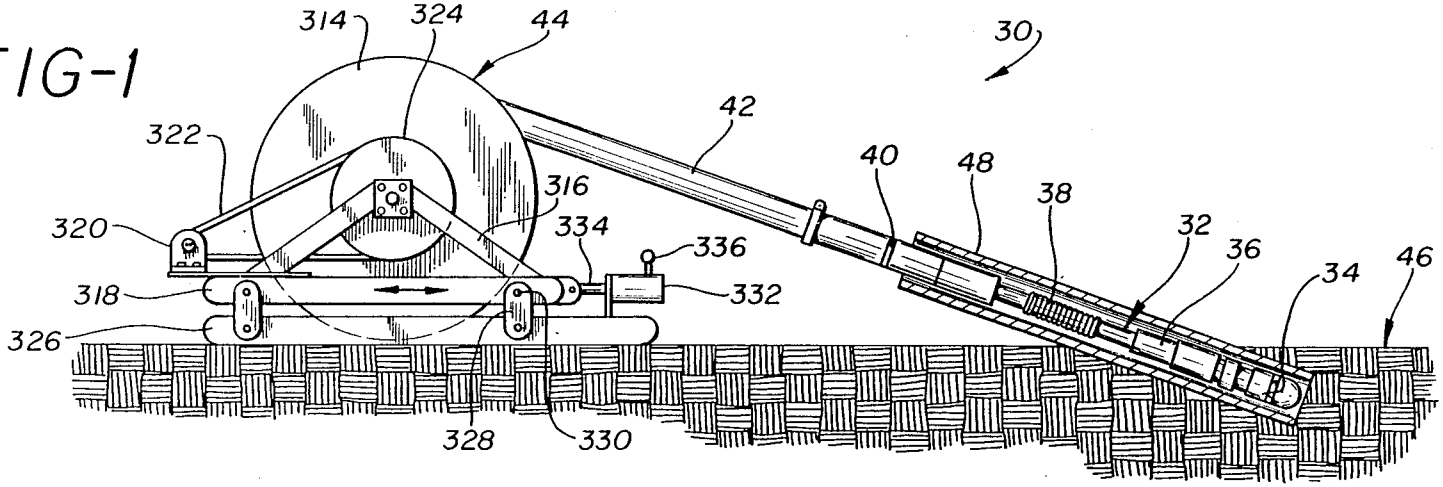
FIG. 1 is a side elevation view, partially in section, of a self-propelled subsoil penetrating tool, the service cable and the reel, constructed in accordance with the concepts of the invention being applied.

Turning now to FIG. 1 there is shown a self-propelled subsoil penetrating tool system 10 constructed in accordance with the concepts of the invention. System 10 is made up of a boring unit 11 mounted to one end of a service cable 12 through which pass all fluid supply lines, hydraulic lines, electrical conductors, a steel wire and fiberglass rods to minimize rotation of the boring unit 11. The service cable 12 is reeled and unreeled from a cable reeling system 13 which provides means to control the tension applied to service cable 12 during reeling and to the steel wire in the service cable 12 during both reeling and unreeling.

Figure 4A:
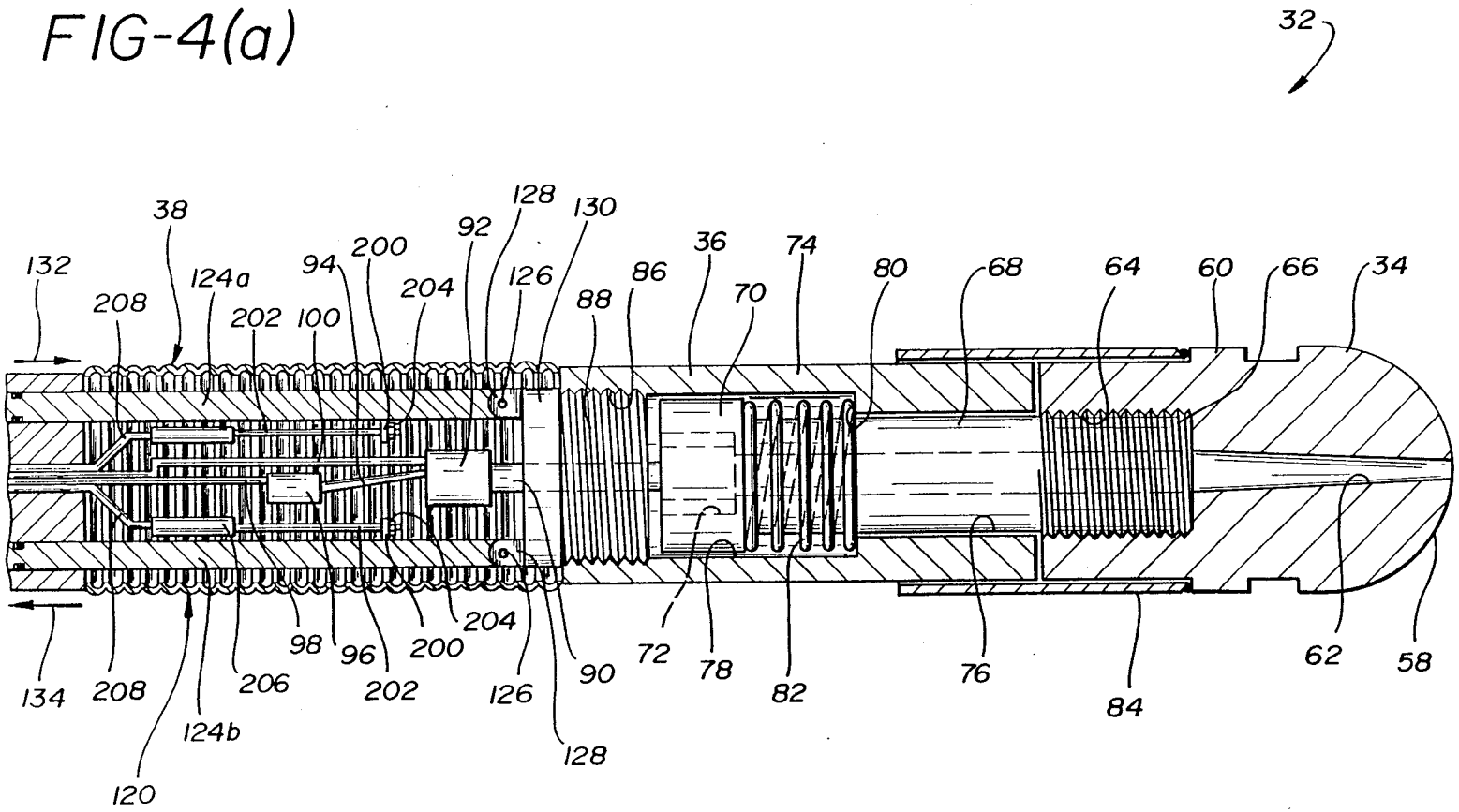
FIG. 4 is a side elevation of parts of the service cable and tool in section taken through a plane passing through the longitudinal axis of the cable and tool. This shows how the cable and tool are connected.
Figure 4B:
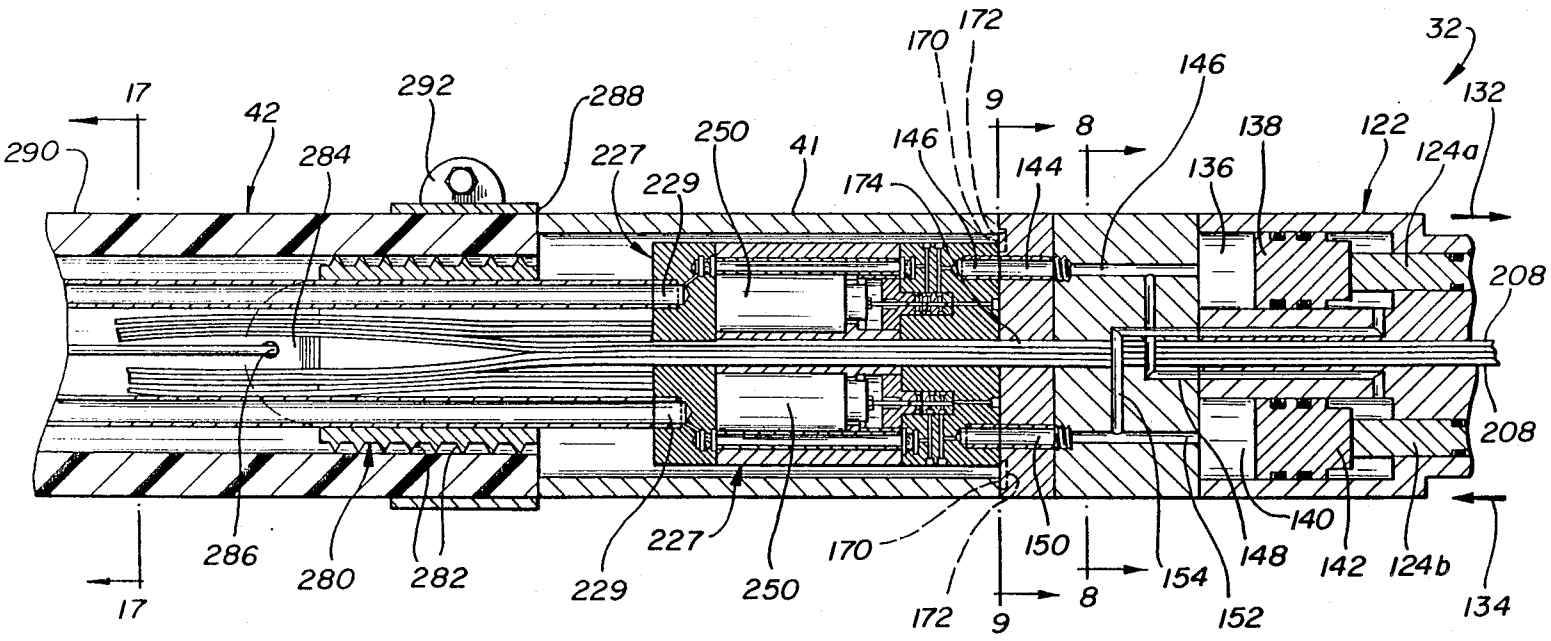
Figure 5:
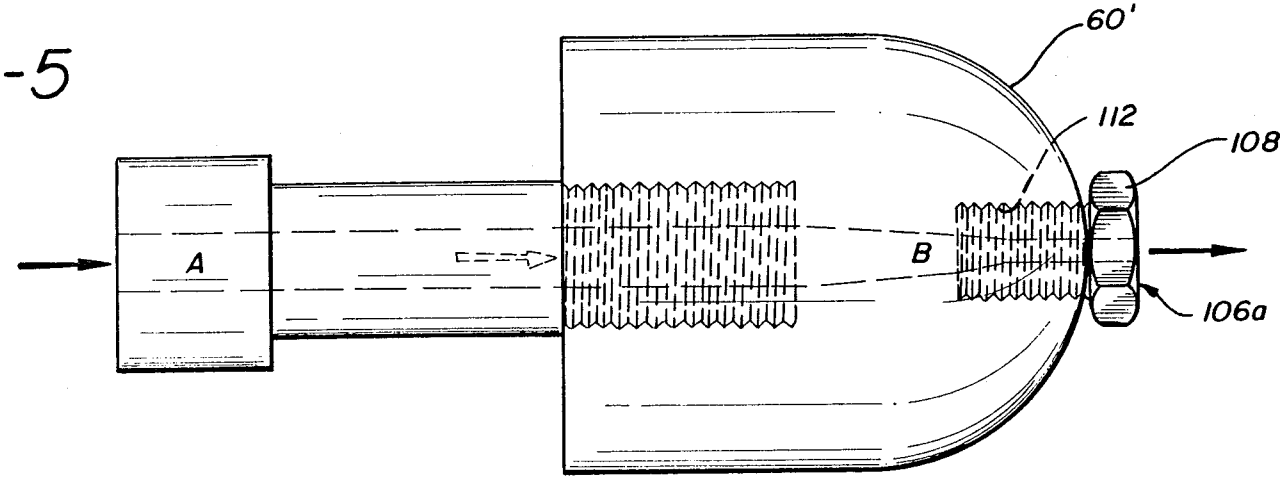
Figure 6:
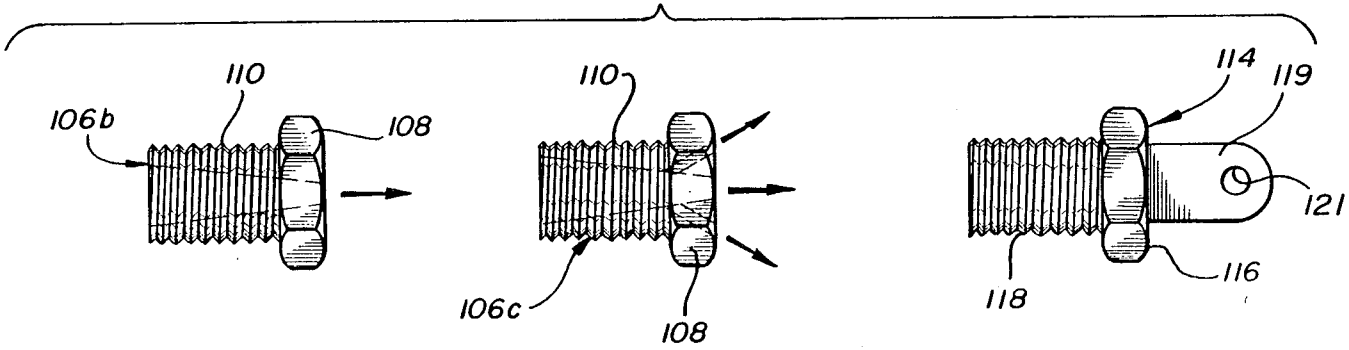
Figure 7A:
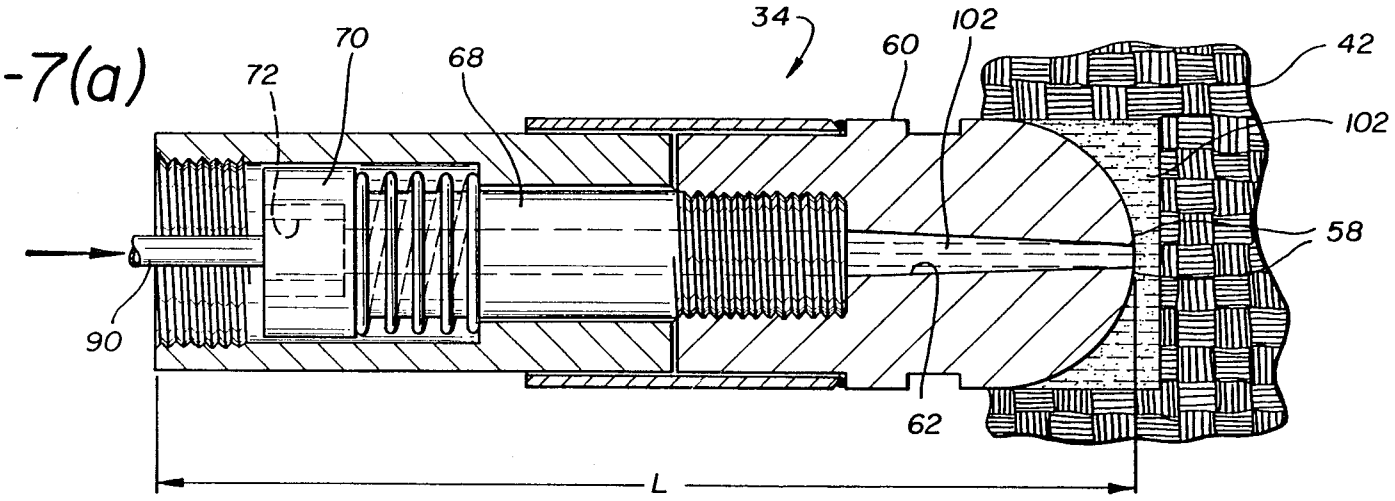
Figure 7B:
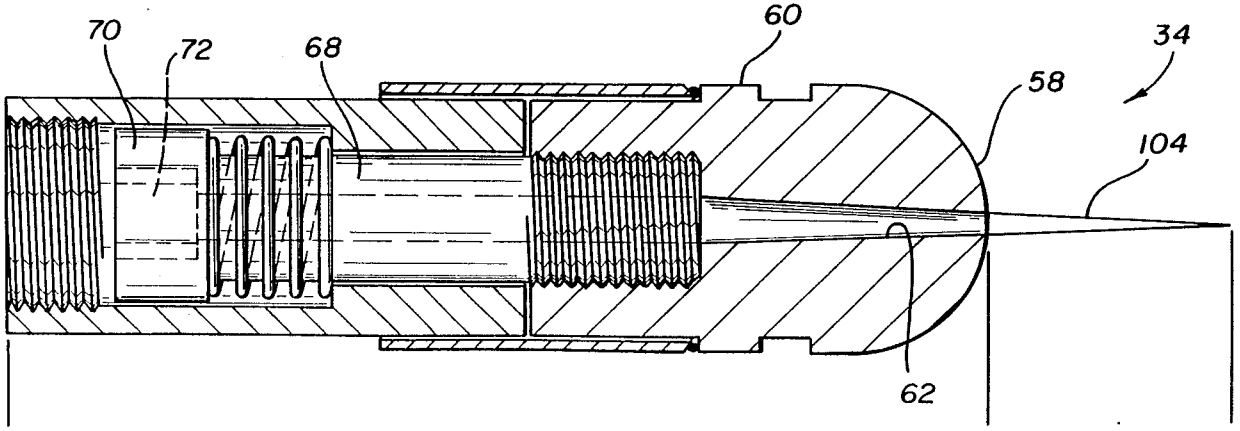
Figure 7C:
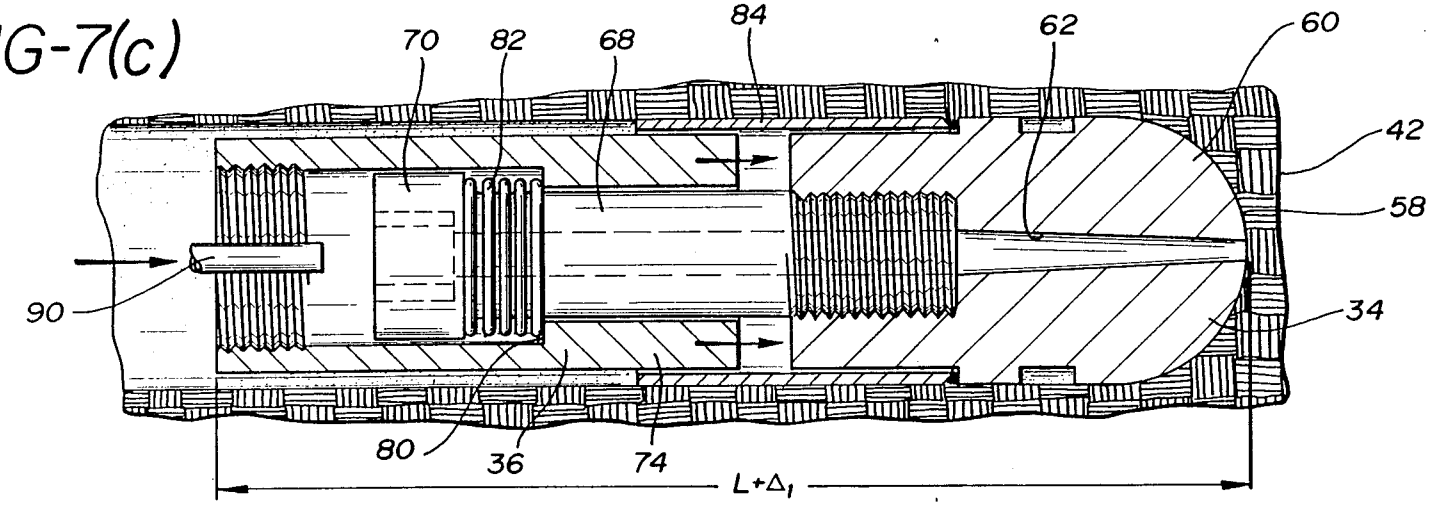
Figure 7D:
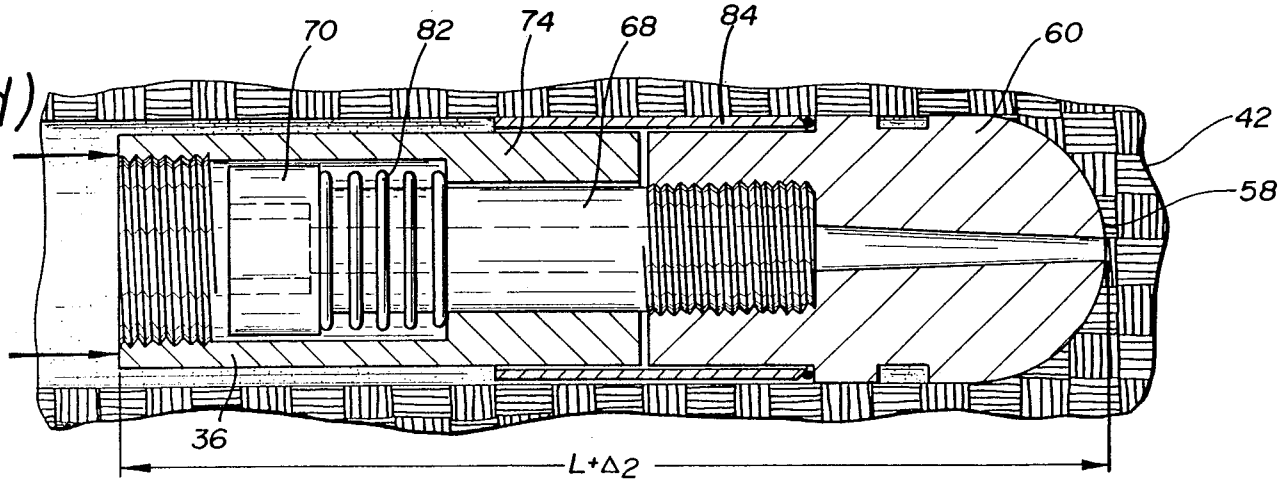
Figure 8:
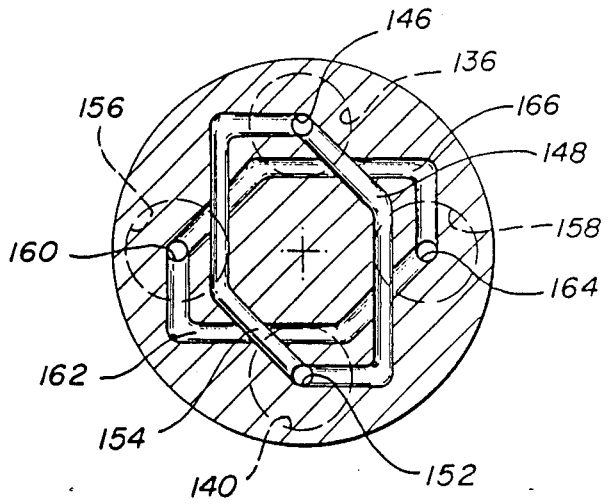
Figure 9:
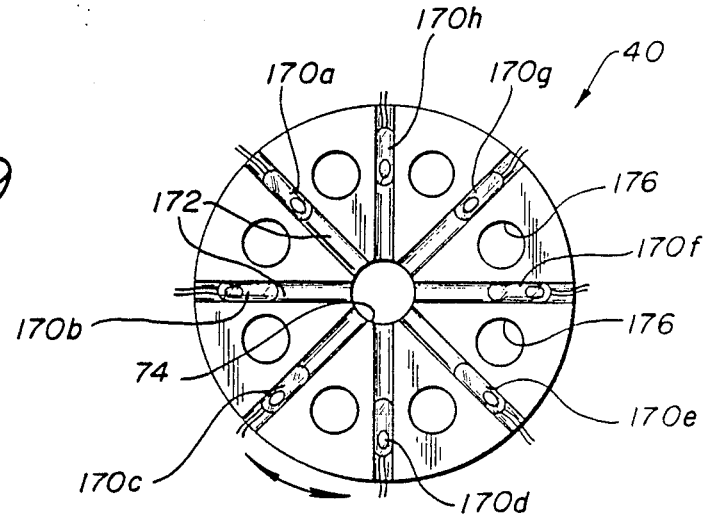
Figure 10:
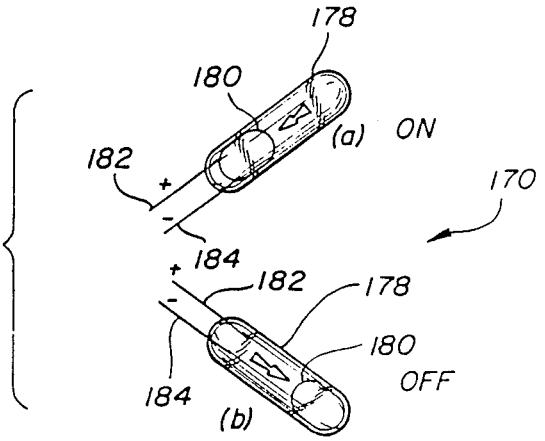
Figure 11:
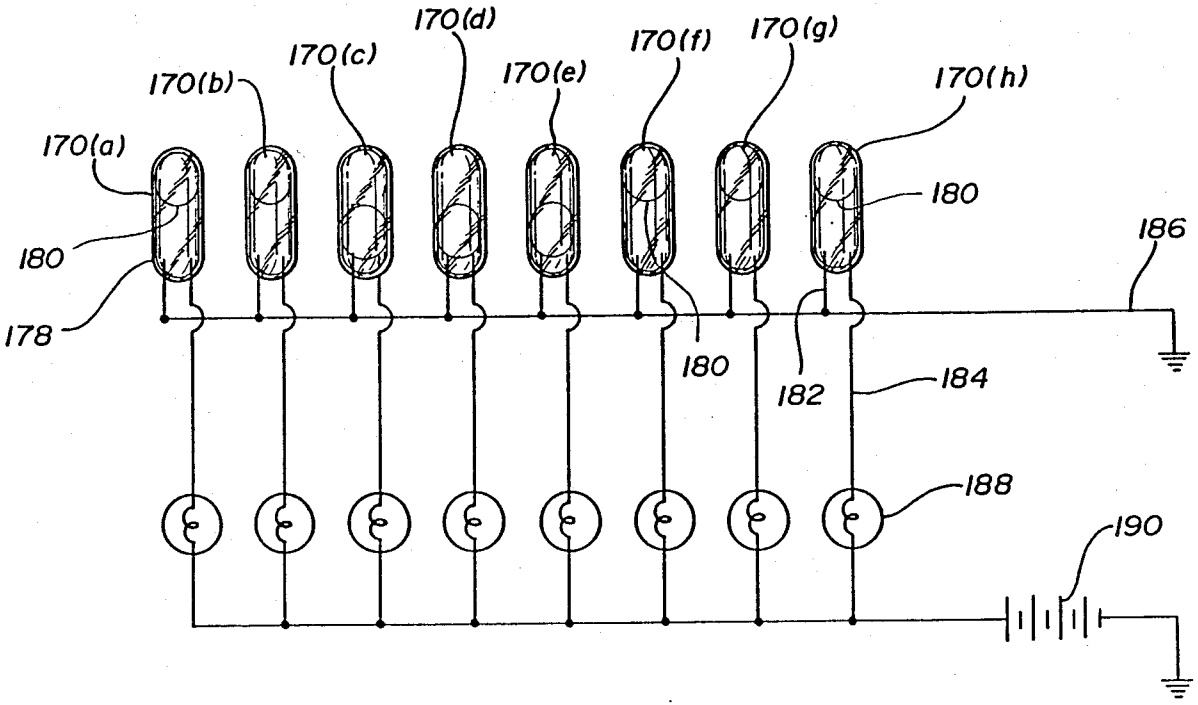
Figure 12:
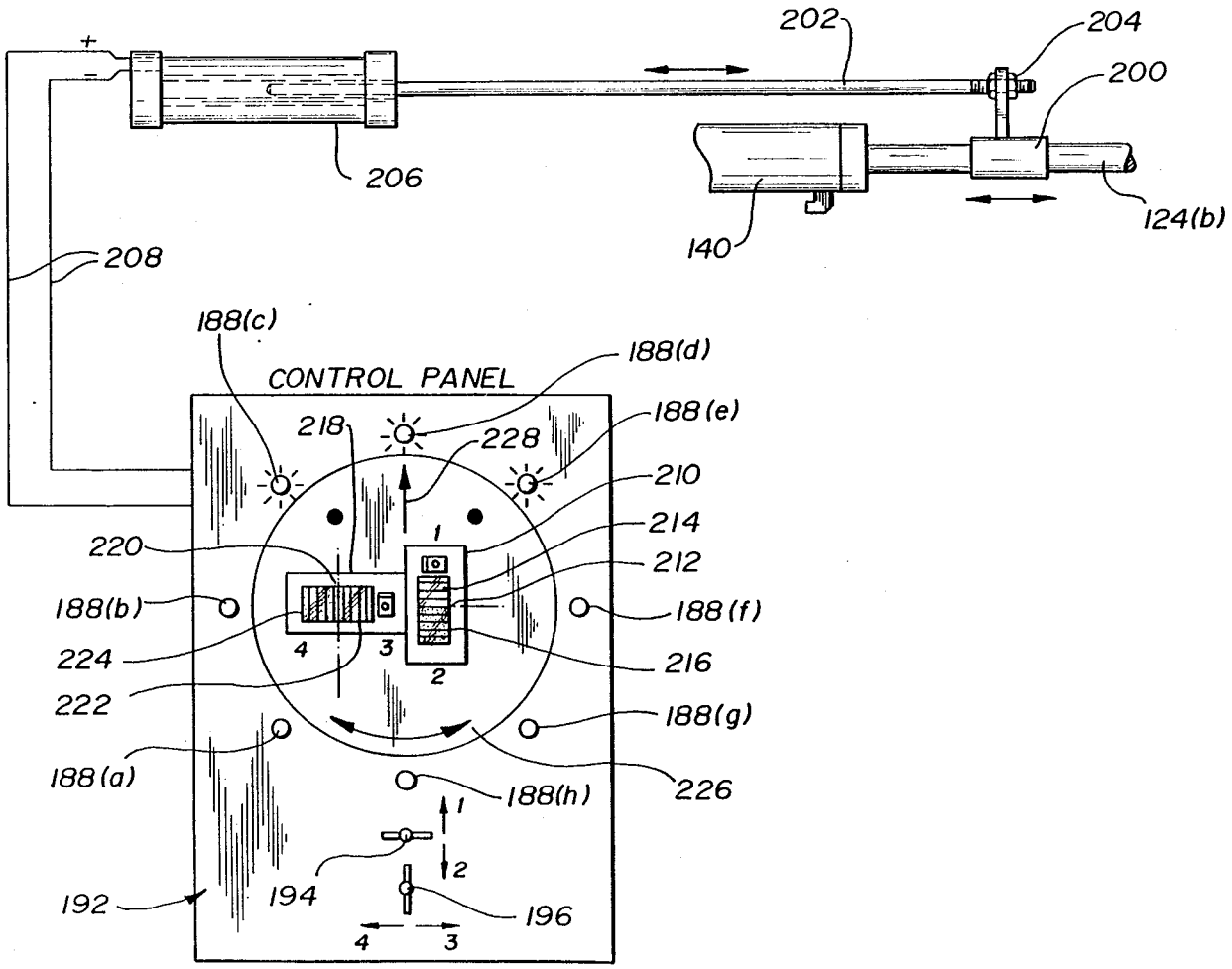
Figure 13:
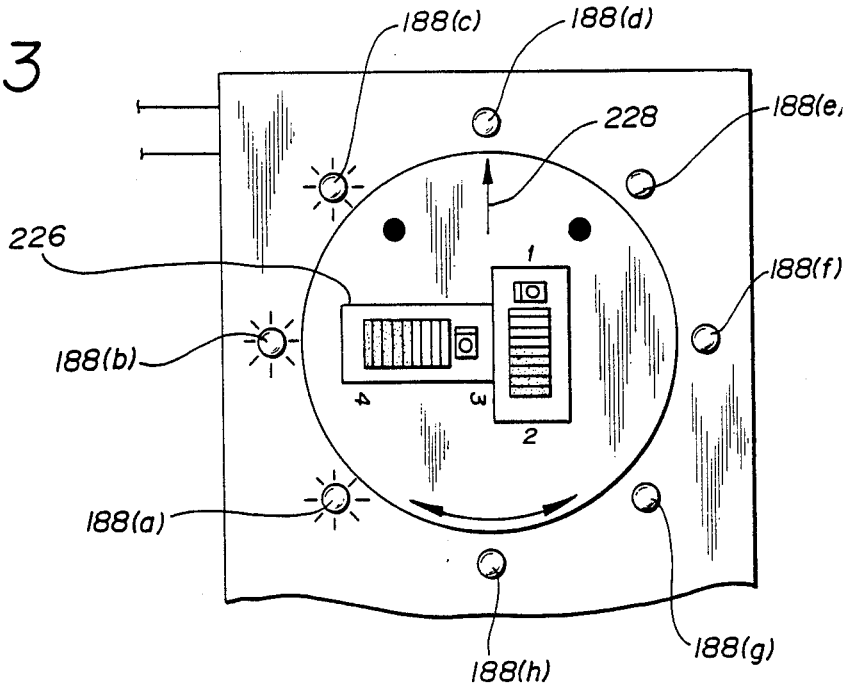
Figure 14:
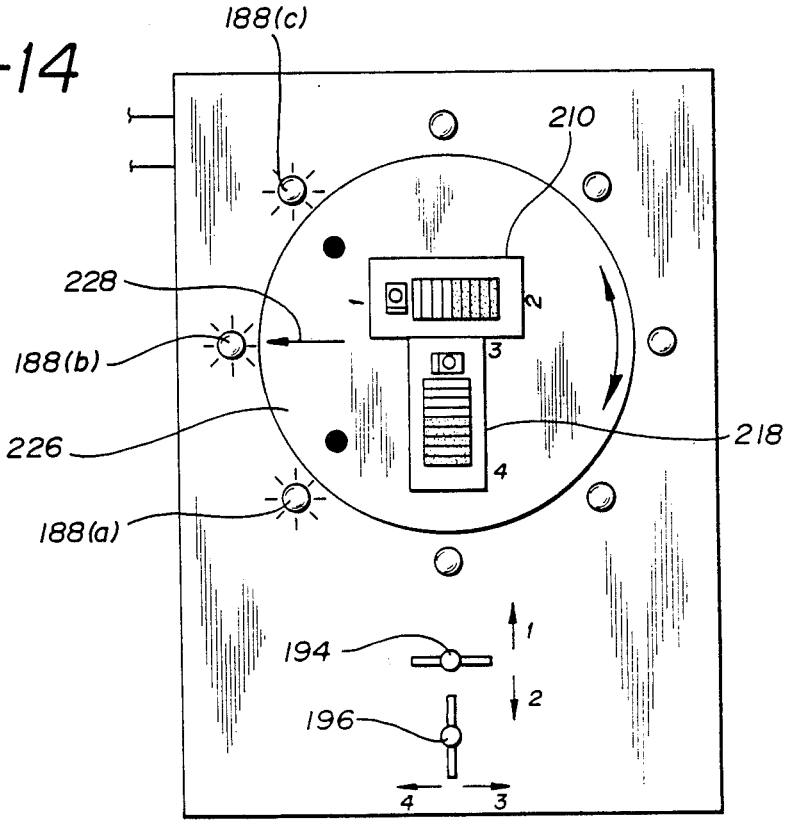
Figure 15:
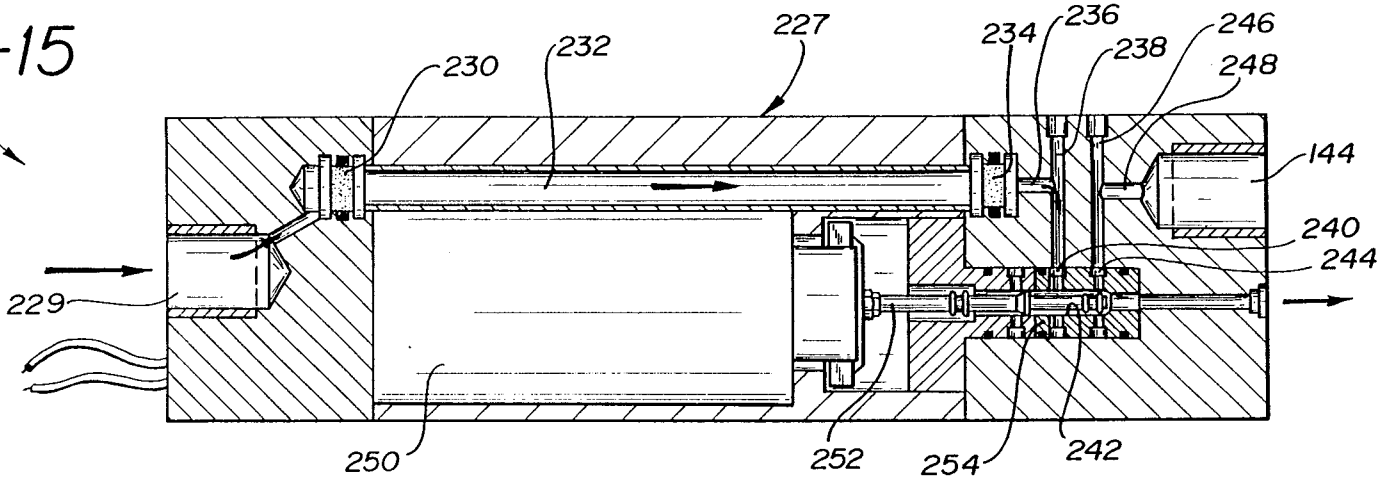
Figure 16:
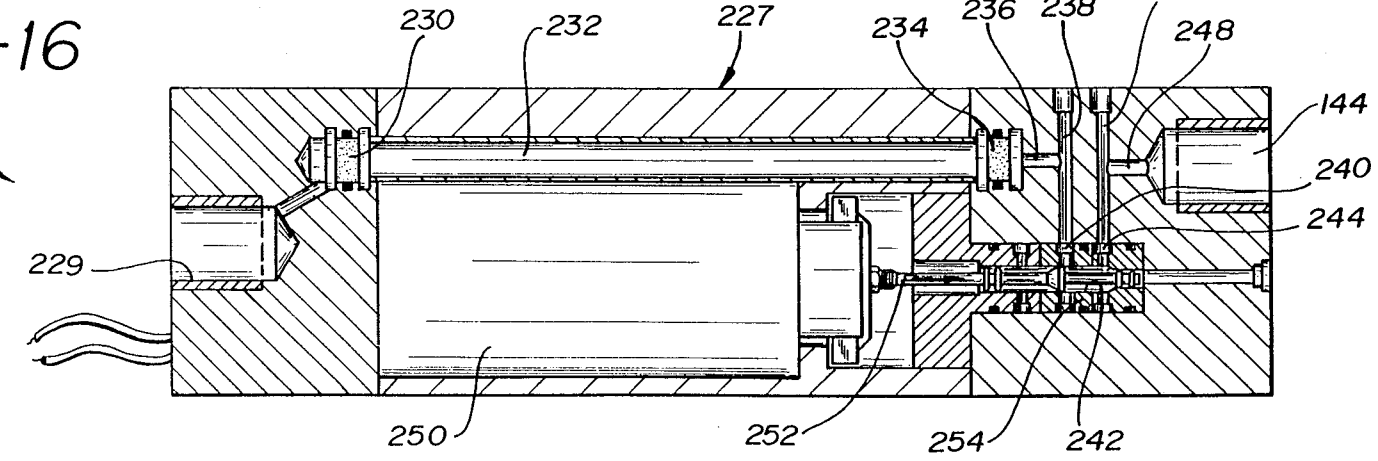
Figure 17:
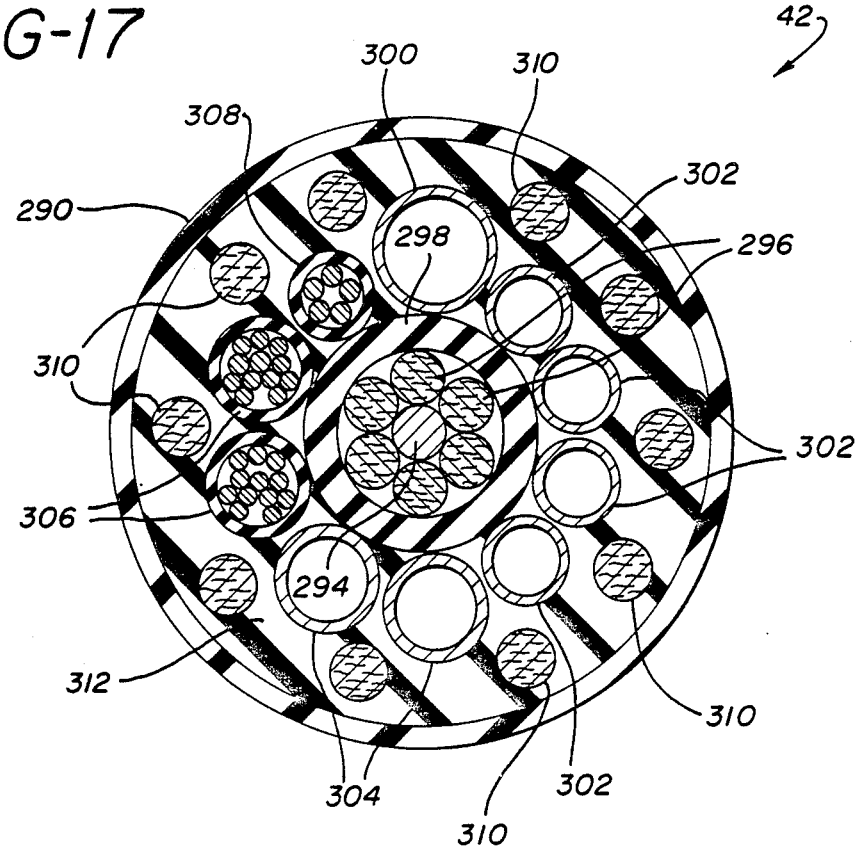
Figure 19:
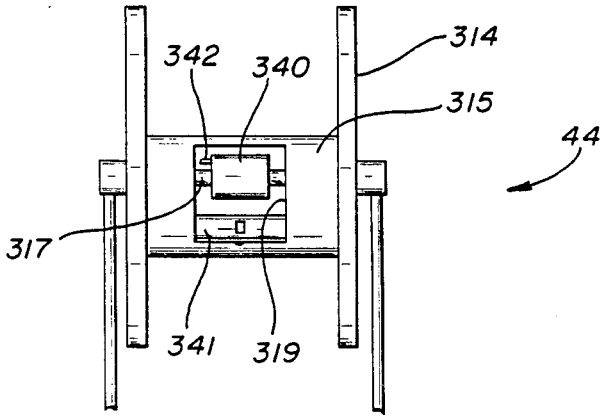
Figure 18:
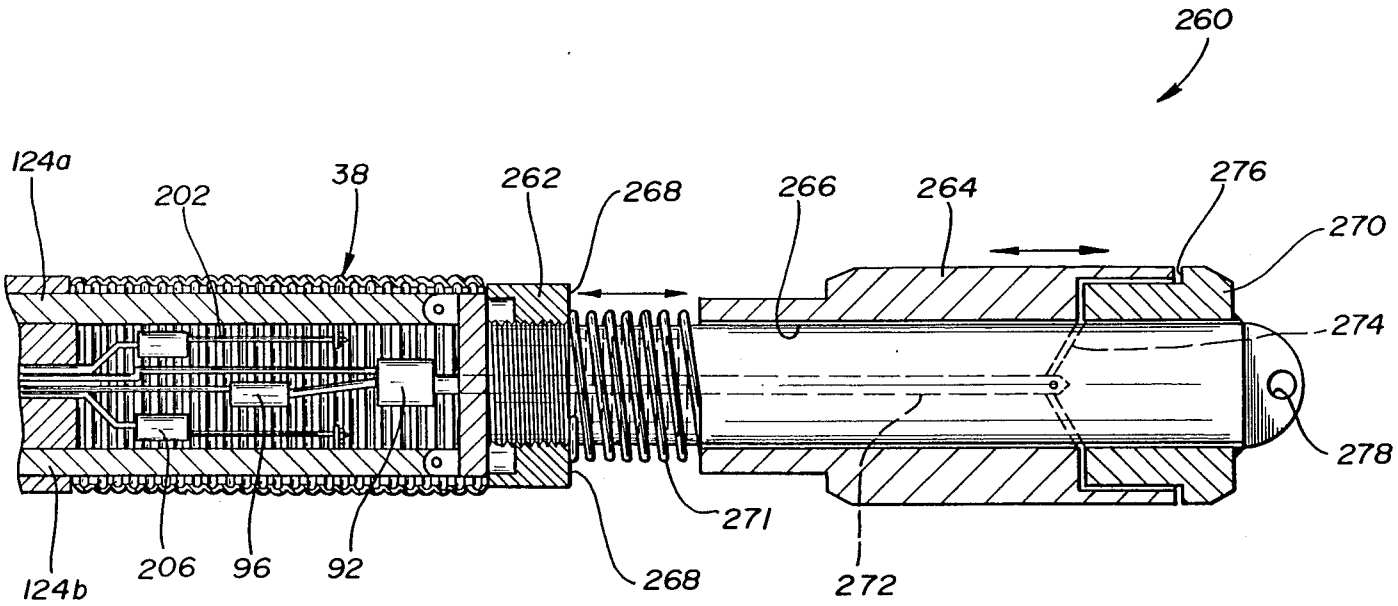

All essential fluid, hydraulic and electrical conductors are housed in the service cable 12 fastened to the housing 14. Figure 4 shows that housing 14 is decreased in outside diameter as at 20 and that the outer surface is formed with a series of ridges 21. At the end of the body portion, a plate 22 is fixed across the opening dividing the same in half so that the various lines, tubes and conductors can pass over either face of plate 22 and enter the boring unit housing.

An aperture 23 is placed in plate 22 for purposes to be described below. Service cable 12 is prepared so that the various lines, tubes and conductors are separated and extend beyond the outer jacket 24 of service cable 12 so that they can pass along plate 22 into the boring unit 11 for attachment to their respective components. The end of outer jacket 24 is brought up against end 25 of housing 14 over the ridges 21 in the reduced-diameter portion 20 and clamped thereto by use of a stainless steel hose clamp 26 of a construction well known in the art.

Figure 2:
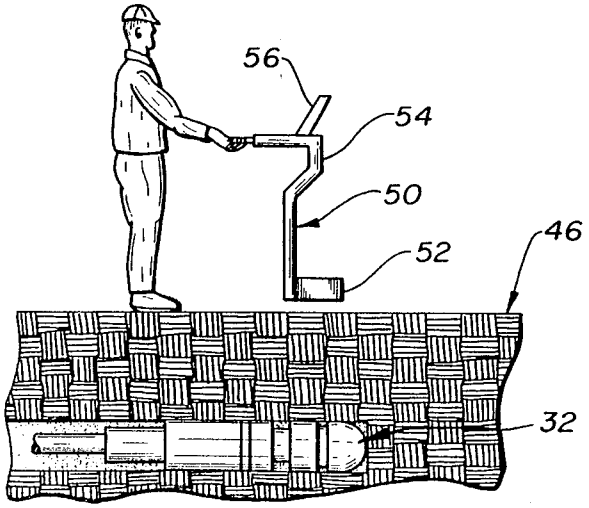
FIG. 2 is a cross-section, taken along the line 2—2 of FIG. 4, of the service cable used in the penetrating tool system of FIG. 1.

The makeup of service cable 12 is best appreciated from a consideration of FIG. 2. At the center of service cable 12 is a steel wire 27 which is attached to plate 22 by means of aperture 23. The wire 27, having a diameter of about 0.250 inch, can be used to pretension the service cable 12 and thus reduce the tendency of the boring unit 11 to rotate by providing a more rigid trailing cable and to provide the main pulling line for drawing the boring unit 11. Steel wire 27 is surrounded by six fiberglass rods 28 also having a diameter of about 0.250 inch. These rods are applied with a slight twist (1 wrap per 9 lineal feet) rather than exteding in parallel with steel wire 27. These rods can provide crush support, and when used with further fiberglass rods having a reverse or opposite twist, tend to keep service cable 12 from rotating. Steel wire 27 and fiberglass rods 28 are surrounded by an extruded jacket 29. Along the outer surface of jacket 29 are arranged the 2,000-pounds-per-square-inch working pressure drill mud hose 30; four 2,000-pounds-per-square-inch working pressure hydraulic hoses 31; two 5,000-pounds-per-square-inch working pressure air hoses 32, two electrical cables 33, each composed of six pair of 22-gauge stranded conductors; and electrical conductor 34. Surrounding these hoses and conductors is a second ply of ten 0.250-inch fiberglass rods 35 applied with a twist direction opposite to that of fiberglass rods 28 and of a greater twist, being one wrap in 4.5 lineal feet. The net effect of these two counter-twist plys of fiberglass rods is to support and strengthen the cable 12 and to resist any tendency to rotate in either direction in tension or compression. Also, as stated above, the steel wire 27 can be tensioned before any tension is applied to the overall cable 12 and this pre-tensioning tends to make the cable 12 more rigid, also preventing rotation during reeling or unreeling and allowing compressive forces to be translated through cable 12 to the boring unit 11.

The cable 12 is further protected and reinforced by pressure extruding a polyethylene interior jacket 36 and a polyurethane wear jacket 24 over the cable core and components.

The unreeling of the supply cable 12 is generally controlled by the boring unit 11. As it advances, it pulls the supply cable 12 after it. However, the longer the supply cable 12 runs, the greater is the need for a power assist in inserting supply cable 12 into the bore.

Figure 3A:
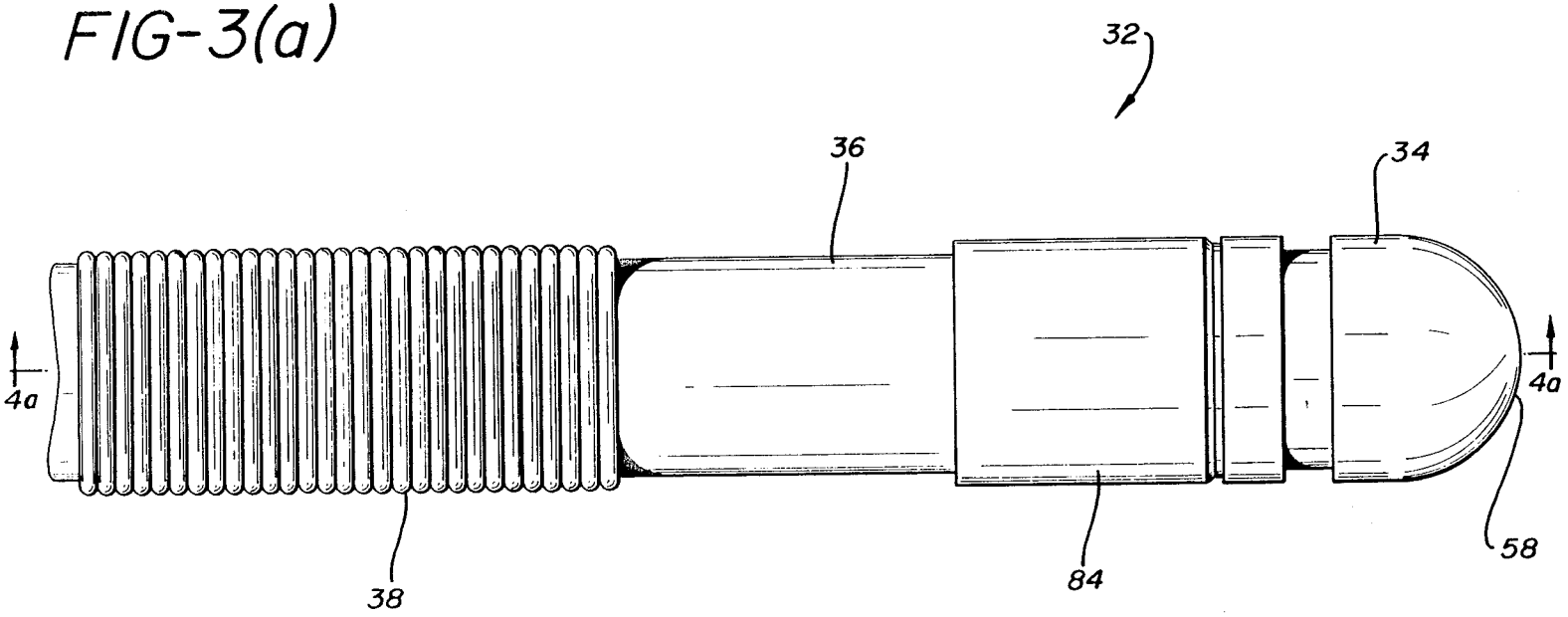
FIG. 3 is a fragmentary front elevation of a reeling system for use in reeling and unreeling the service cable with a separate device provided to pretension the steel wire of the service cable.
Figure 3B:
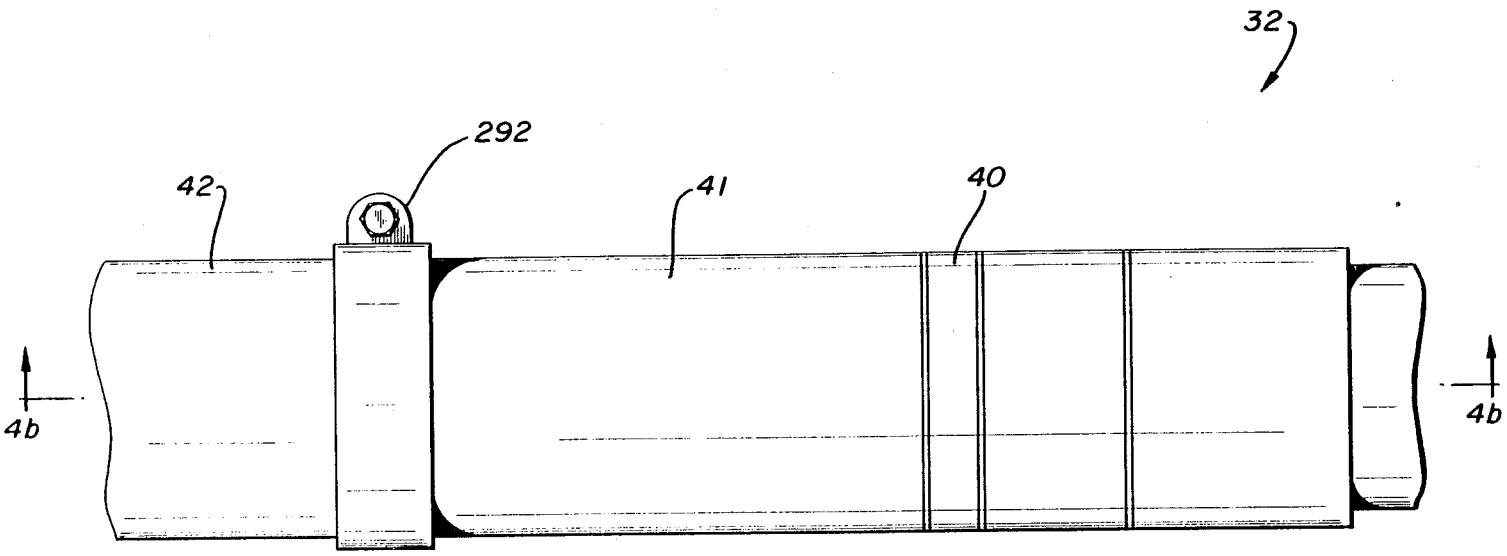

In order to control the tension applied to the steel wire 27 separately, a hand-operated reel 40 is mounted inside the hub 41 of reel 42, all part of cable reeling system 13 (see FIG. 3). An access door 43 in hub 41 is opened and the steel wire 27 end is attached to reel 40, and by turning the manual cranks 44, the tension in the steel wire 27 can be pre-adjusted. The entire supply cable 12 can then be wound upon reel 42.

While there have been shown and described and pointed out the fundamental novel features of the invention as applied to the preferred embodiments, it will be understood that various omissions and substitutions and changes of the form and details of the devices illustrated and in their operation may be made by those skilled in the art without departing from the spirit of the invention.

The embodiments of the invention in which an exclusive property or privilege is claimed are defined in the claims.

I claim:

1. A flexible service cable containing a plurality of parallel elongate tubes, hoses and electrical conductors extending in the direction of the longitudinal axis of such cable, and: means to prevent rotation of said service cable about its longitudinal axis while said service cable is in compression so as to present its component tubes, hoses and electrical conductors at the same radial positions at both ends thereof comprising: an elongate tension member having a first end and a second end extending through the center of said cable in the direction of the longitudinal axis thereof; means coupled to said elongate tension member first end to anchor said elongate tension member adjacent the first end of said service cable; and tension-generating means coupled to said elongate tension member second end adjacent the second end of said service cable to apply tension to said elongate tension member independently of said service cable to compress and thereby rigidify said service cable so that an additional axial compressive force can be applied to said second end of said service cable which will allow the force to be more easily translated through said cable.

2. The cable as defined in claim 1, wherein said elongate tension member is a steel wire.

3. The cable as defined in claim 2 where the means to prevent cable rotation further comprises: a first wrap of first elongate strengthening rods adjacent said elongate tension member; and a second wrap of second elongate strengthening rods outside said first wrap, the wrap directions of said first wrap and said second wrap being generally opposite.

4. The cable as defined in claim 3, wherein said first and second elongate strengthening rods are fiberglass.

5. The cable as defined in claim 3, wherein the wrap rate of the first elongate strengthening rods is twice as long as the wrap rate of the second elongate strengthening rods.

6. The cable as defined in claim 5, wherein the wrap rate of the first elongate strengthening rods is one per nine lineal feet and the wrap rate of the second elongate strengthening rods is one per four and one-half lineal feet.

7. The method of preventing the rotation of a flexible service cable about its longitudinal axis when said cable is in compression, said cable containing a plurality of parallel elongate tubes, hoses and electrical conductors extending in the direction of the longitudinal axis of such cable, comprising the steps of:

placing an elongate member having a first end and a second end in said cable capable of being placed under tension;

coupling a first end of said elongate member, adjacent the first end of said cable, to a rigid fitting;

coupling the second end of said elongate member, adjacent the second end of said cable, to a means for applying tension;

placing around said elongate member means to prevent rotation of said cable about its longitudinal axis while said cable is in compression so as to present its component tubes, hoses and electrical conductors at the same radial positions at both ends thereof; and applying a predetermined tension to said elongate member which places all but the elongate member of said cable in compression whereby said service cable becomes generally rigid.

8. The method of preventing the rotation of a flexible service cable as defined in claim 7 where the step of placing means to prevent rotation of said cable includes the further steps of placing a first wrap of first elongate strengthening rods adjacent the elongate member of said cable; and placing a second wrap of second elongate strengthening rods outside said first wrap such that the wrap directions of said first and second wraps are generally opposite.

9. The method as defined in claim 8, wherein the steps of placing wraps of elongate strengthening rods include placing fiberglass rods as the first and second elongate strengthening nrods.

10. The method as defined in claim 8, wherein the steps of placing wraps of elongate strengthening rods include placing the first wrap of strengthening rods at a wrap rate twice as long as the wrap rate of the second wrap of strengthening rods.

11. The method as defined in claim 8, wherein the steps of placing wraps of elongate strengthening rods include placing the first wrap of strengthening rods at a rate of one wrap per nine lineal feet.

* * * * *